US007385508B1

(12) United States Patent
Ray et al.

(10) Patent No.: US 7,385,508 B1
(45) Date of Patent: Jun. 10, 2008

(54) NON-RIGID CARD HOLDER WITH DISPLAY

(76) Inventors: Coleman Ray, 1580 E. Sandpiper Cir., Pembroke Pines, FL (US) 33026; Cruise P. Berrio, 4939 SW. 135th Ct., Miami, FL (US) 33075; Kenneth R. Ray, P.O. Box 271, Okeechobee, FL (US) 34973

( * ) Notice: Subject to any disclaimer, the term of this patent is extended or adjusted under 35 U.S.C. 154(b) by 153 days.

(21) Appl. No.: 10/907,455

(22) Filed: Apr. 1, 2005

Related U.S. Application Data

(63) Continuation-in-part of application No. 10/384,480, filed on Mar. 7, 2003, now Pat. No. 6,876,301.

(51) Int. Cl.
*G08B 13/14* (2006.01)

(52) U.S. Cl. ..... 340/568.7; 340/568.1

(58) Field of Classification Search ..... 340/568.1, 340/568.7, 531, 571, 5.26; 362/154, 200; 705/50–80
See application file for complete search history.

(56) References Cited

U.S. PATENT DOCUMENTS

| | | | | |
|---|---|---|---|---|
| 4,652,865 | A * | 3/1987 | Maharshak | 340/568.7 |
| 4,692,745 | A | 9/1987 | Simanowitz | |
| 4,719,453 | A | 1/1988 | Beck et al. | |
| 4,890,094 | A | 12/1989 | Kopel | |
| 4,916,434 | A | 4/1990 | McNeely | |
| 5,034,724 | A | 7/1991 | Tone | |
| 5,373,283 | A | 12/1994 | Maharshak | |
| 5,418,520 | A | 5/1995 | Hirshberg | |
| 5,515,031 | A * | 5/1996 | Pereira et al. | 340/693.3 |
| 5,642,095 | A | 6/1997 | Cook | |
| 5,892,444 | A | 4/1999 | Wittmer et al. | |
| 6,184,788 | B1 | 2/2001 | Middlemiss et al. | |
| 6,707,382 | B2 * | 3/2004 | Pedersen | 340/568.1 |
| 6,816,058 | B2 * | 11/2004 | McGregor et al. | 340/5.26 |
| 6,954,133 | B2 * | 10/2005 | McGregor et al. | 340/5.26 |
| 2004/0113819 | A1 * | 6/2004 | Gauthey et al. | 341/34 |
| 2004/0220807 | A9 * | 11/2004 | Tamir et al. | 704/246 |

* cited by examiner

*Primary Examiner*—Benjamin C. Lee
*Assistant Examiner*—Shirley Lu
(74) *Attorney, Agent, or Firm*—Malin Haley DiMaggio Bowen & Lhota, P.A.

(57) ABSTRACT

A card holder for credit card, debit card, smart card and identification card, comprising a holder for a card including a holder body having two walls that form a recess adapted for holding a card, an electrical contact for triggering a display located in a recess of the holder, a power source in electronic communication with the contact, and an LCD display located on an outer surface of the holder. The display is able to access data stored on the card. The holder has an audible and/or vibrational alarm. The display has touch screen properties or has menu buttons, or both.

16 Claims, 3 Drawing Sheets

NON-RIGID CARD HOLDER WITH DISPLAY

FIELD OF THE INVENTION

This invention relates to a card holder in general, and more specifically to mechanism that holds a card and provides a display for showing information regarding the card and/or the holder.

DESCRIPTION OF PRIOR ART

Credit and debit cards are widely used in purchasing goods and services in society today. Their use is pervasive as people can use them at a variety of locations. Unfortunately, sometimes a card owner will inadvertently leave a credit card or other important card in a store or similar place. If an owner has several cards and carries them often, the loss may remain unnoticed for a considerable time. The longer the time such a mistake remains unnoticed, the harder it is to recall exactly where the card may have been left. The headache and waste of time suffered by the owner in replacing these cards can be a severe nuisance. Moreover, unauthorized persons may then have access to the card and run up charges or run down accounts on the card.

Also, sometimes it is important to obtain information which is recorded on the credit or debit card quickly. In addition, the information read from the card should be securable by means such as a PIN number. Furthermore, the data may need to be viewed easily. A visual indicator of information such as the time and/or place of the last transaction would benefit the user immensely. The display may also be used to make or change settings for an alarm function for the holder.

A lost identification card can also be difficult and expensive to replace when it is lost. Many identification cards are approximately the size and shape of a credit or debit card, and may be protected by means otherwise designed for the protection of credit or debit cards.

Card holders which incorporate alarms are well known in the prior art. U.S. Pat. No. 5,418,520 to Hirshberg discloses a card holder with a power source and a chip programmable to a speak a human voice so that it is less obtrusive than a mechanical alarm. U.S. Pat. No. 4,916,434 to McNeely teaches the use of an electronic system with metallic switch arms and spring clips which are rigid in nature. U.S. Pat. No. 4,692,745 to Simanowitz demonstrates a dual trigger alarm system requiring the opening or closing of a briefcase or outer wallet to trigger the alarm on the card holder. U.S. Pat. No. 4,890,094 to Kopel discloses a bulky accordion-style folding credit card holder that uses dielectric sheets as contacts for the alarm system. U.S. Pat. No. 5,892,444 to Wittmer et al. teaches an alarm system for multiple cards using bulky flexible conductive ribbon to conduct electricity to the alarm. Also, U.S. Pat. No. 5,642,095 to Cook illustrates a complicated alarm system with components remote from the card holder in triggering the alarm. U.S. Pat. No. 6,184,788 to Middlemiss et al. discloses an electronic system for a hard shell credit card holder with a visible as well as audible alarm that sounds when a card has been taken out. U.S. Pat. No. 5,034,724 to Tone teaches a multi-part alarm system in which the cards are located in a hard plastic holder. Also, U.S. Pat. No. 4,719,453 to Beck et al. discloses a multiple card carrier using metal parts at both the electrical contacts and the flanges. In addition, U.S. Pat. No. 5,373,283 to Maharshak teaches another accordion-style credit card case which incorporates conductor strips in the contacts for triggering the alarm.

In addition, card alarms having a flexible structure and having internal guides for the card are known in the art, as described in U.S. patent application Ser. No. 10/384,480. However, this invention has no display whatsoever.

These devices all have the disadvantage that there is no associated display. In addition, they are incapable of taking advantage of the readable data available on the Smart Chip installed on many credit cards, debit cards or similar cards. The Smart Chip contains various data associated with the card's use and the user's account, such as the time and place of transactions and the status of the user's account. The instant availability of this information from a holder, especially as it is coupled with an alarm function, would help card users immensely by having an item with important individual features as well as combined functionality. Having the display of the information and access to alarm functions protected by means such as a PIN number also would be beneficial and make use of the holder more secure for the user.

Thus, a reliable, easy to manufacture credit card holder having a display is needed. Moreover, a holder that has a display and an associated alarm function would also be desired by many credit card users. Furthermore, such a holder that can read and display information would be extremely useful to the user in that it would be comfortable to wear, easy to use, and easy to view in dark situations, such as in a bar.

There is a need for a credit, debit, and smart card holder that can provide an interactive display that allows the user to obtain useful information on the display from a smart card contained therein, while, at the same time, providing for an alarm system and a security pin number that must be activated in order to access the portable hand held display that is mounted on the holder. Thus, a card holder that can be carried in a wallet with the credit card or smart card that has an interactive display that the user can access while maintaining security features such as an alarm and the requirement of a pin number is highly desirable.

SUMMARY OF THE INVENTION

A card holder having a credit card sized, rectangular shape that includes front and back rectangular walls sealed along three sides, a battery compartment, integrated circuit chips mounted on a circuit board connected thereto and an LCD display mounted on one side connected to the battery and the chips. The card holder is such that it can be used with a credit card, a debit card, preferably a smart card that includes a smart chip located on the smart card and an identification card. The holder also includes a plurality of access keys (buttons) that can be used to drive a visually displayed menu on the LCD display screen for the user. The card holder is wallet sized to fit into a conventional wallet that normally would receive a credit or debit card.

The card holder also includes an audible and/or vibrational alarm to signal when the card is removed from the card holder or after the card has been removed for an extended period of pre-determined time.

The card holder body may be constructed from a plastic material that makes it lightweight yet sturdy and somewhat rigid. The holder may also be constructed from a polypropylene silicone or similar material. The LCD display may be such as a royal Phillips Electronics display module or the equivalent as known in the art which is preferably flexible. The power source is one or more batteries such as Panasonic CR2016 battery.

The heart of the system is a printed circuit board attached to the interior section in the bottom portion of the card holder. Discrete integrated circuit chips are attached to the board.

The menu that is available for the user can have several modes to access to include a smart card chip data mode, a design of card charges, a set up mode for PIN number and user information, a calculator mode, date and time display, notepad mode, alarm setting mode, display back light and other preferential modes including the vibration and audible alarm setting mode.

The card holder in accordance with the present invention may operate and function with different types of cards and provide different services to the user. For example, with the credit card and debit card or identification card, the card holder functions as an alarm for security purposes and also provides other information on the display such as a calculator function, time and date or even store telephone numbers or other information that is desirable to the user.

In the preferred embodiment, the holder will interact with a "smart" card which is a credit or debit or identification card that includes a smart chip that contains information that can be provided to the holder user through the LCD display on the holder. This could be information as to the last transaction, the balance of credit on the smart card or any other information of importance.

The card holder may also include an indented portion on the card holder body that allows for easy gripping and removal or insertion of the card.

It is an object of this invention to provide a card holder for credit cards, debit cards, identification cards and smart cards that includes a visual display on the exterior of the card holder to provide useful information to the user while, at the same time, providing a card holder that provides security against loss or removal of the card from the card holder.

And yet another object of this invention is to provide an improved card holder that includes an integrated circuit board, battery power source and a visible display that can be used to interact with a smart card positioned within said holder to display useful information to the card user.

In accordance with these and other objects which will become apparent hereinafter, the instant invention will now be described with particular reference to the accompanying drawings.

DETAILED DESCRIPTION OF THE PREFERRED EMBODIMENT

Figure 1:
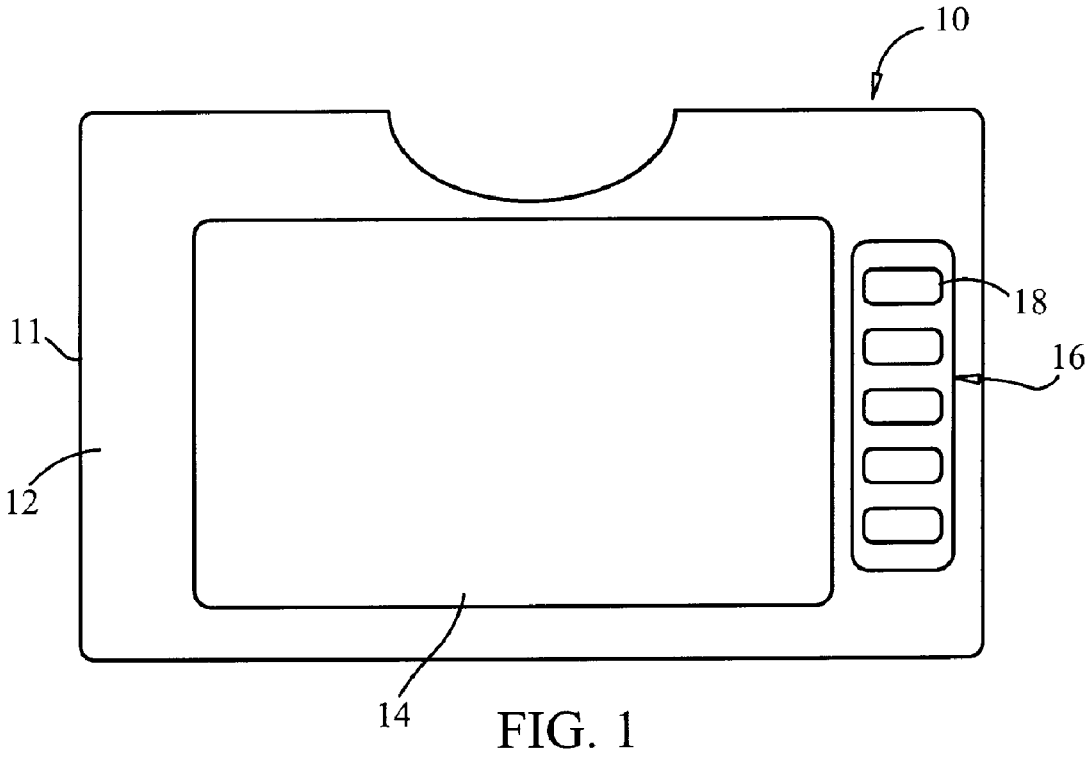
FIG. 1 is a front elevational view of the present invention.
Figure 2:
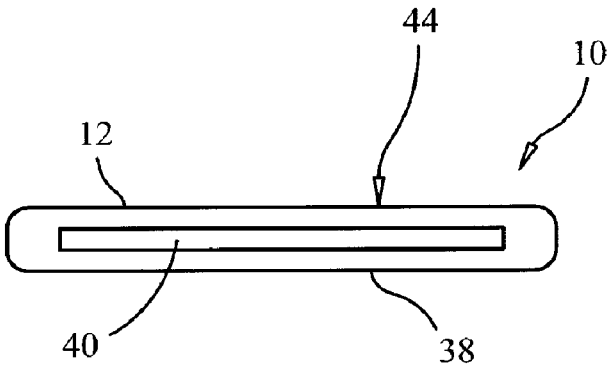
FIG. 2 is a top plan view of the invention.
Figure 3:
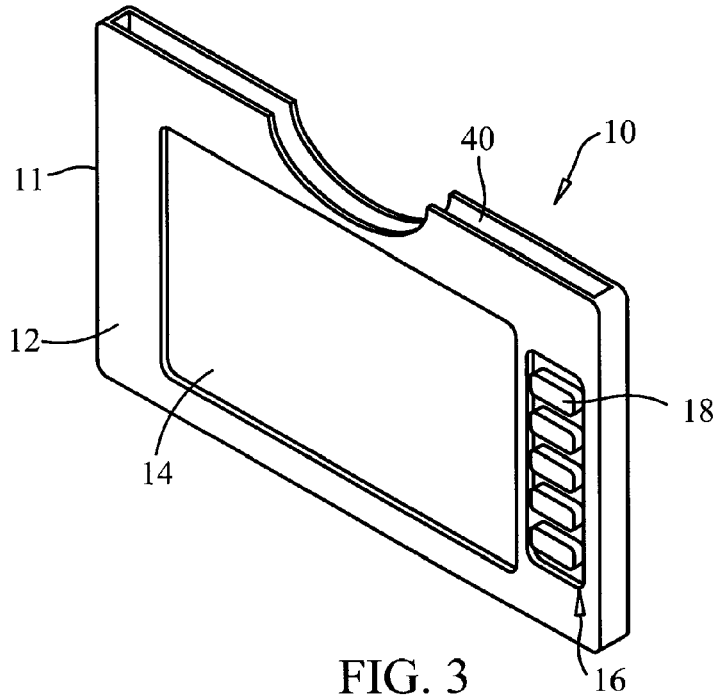
FIG. 3 is a perspective view of the invention.

FIGS. 1-6 show the inventive credit card holder 10 including a display 14. As shown in FIGS. 1-3, the holder 10 includes a holder body 11 shaped to accommodate the shape of a charge card or debit card. The holder body 11 is preferably generally rectangular in shape. Preferably the holder body 11 is made from polypropylene silicon or a similar material. The body 11 has two walls that form a recess 40 for card holding and an exterior surface 44. The holder 10 is preferred to be approximately 5.5 mm high and 9 mm long. The holder body 11 is approximately 0.8 mm thick. It is preferred that the card holding recess 40 comprises a pocket shape within the holder body 11. The holder body 11 is preferred to be thin to minimize potential for discomfort when worn. The body recess 40 may include a ramp 46 mounted on the inside back wall 38 as shown in dotted FIG. 6 for guiding the card into the holder body 11. Preferably, the ramp is made of Mylar or a generally rigid structure coated with Mylar or the equivalent. An equivalent non-metallic material may also be preferred.

The holder body 11 includes an electrical contact for triggering an LCD display 14. The display 14 is preferably a flexible LCD display such as the Royal Phillips Electronics display modules as is known in the art. Preferably, the size of the display is approximately 4 mm by 3 mm. The electrical contact includes a flat ribbon cable 22 located in recess 40 of the holder body 11. Also, the holder body 11 includes at least one electrical power source such as battery 36 in electronic communication with the electrical contact. The preferred power source is one or more batteries, such as the Panasonic CR-2016 battery. It is preferred that the battery is changeable. As shown, the display 14 is at least partially located on the outer front surface of the holder body 11. The holder body 11 has a front wall 12 and a back wall 38. The front wall 12 is attached to the back wall 38 by an adhesive, such as an epoxy resin, or the two walls may be heat-sealed together.

Figure 4:
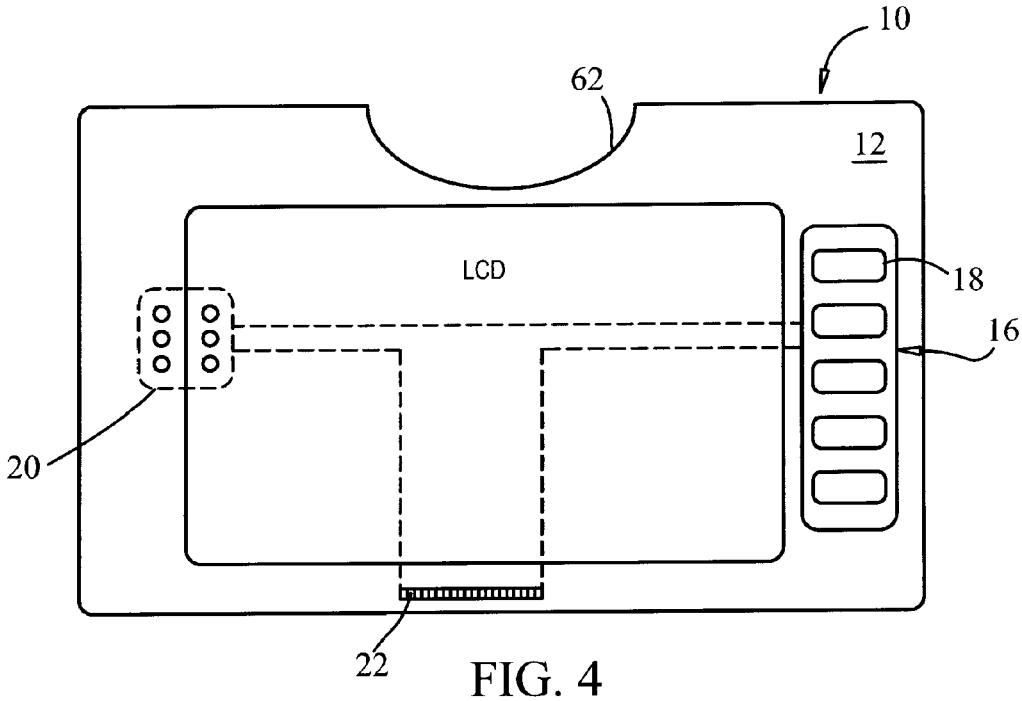
FIG. 4 is a front elevational view of the invention showing a portion of the internal circuitry dotted.

The holder body 11 also has a plurality of buttons 16 accessing data stored on a smart card located on the front wall 12 of the holder. The buttons 16 for accessing data may also allow accessing an alarm associated with the holder 11, or a separate element for accessing an alarm may be provided. As shown in FIG. 4, the buttons 16 include one or more menu switches 18 (or a touchpad) for a user located on the front wall 12 of the holder. The menu switches 18 are preferred to be on the front wall next to the display 14. There are preferably 5 button switches 18, which are, from the top down, a menu button, scroll up and scroll down buttons, scroll left and scroll right buttons and an enter button. The on/off of alarm and/or display comes from the card removal and insertion only.

Alternatively, a touch screen display (not shown) may be used to interact with the data accessed by the display. The user may use the switches 18 to alter the display, such as by increasing the brightness, contrast or size of the text. The user may also use the switches 18 to set preferences for an alarm such as an audible alarm 34 as shown in FIG. 5.

The main menu provided as text or symbols on the display 14 for the user to observe would preferably have several modes for the user to access. In the preferred embodiment, the menu will provide access to one or more of the following modes or displays: a card chip data mode, a display of card charges, a setup mode for PIN number and user information, calculator mode, date and time display, notepad mode, alarm setting mode, display backlight and other preferences mode, and vibration and audible alarm setting mode.

Figure 5:
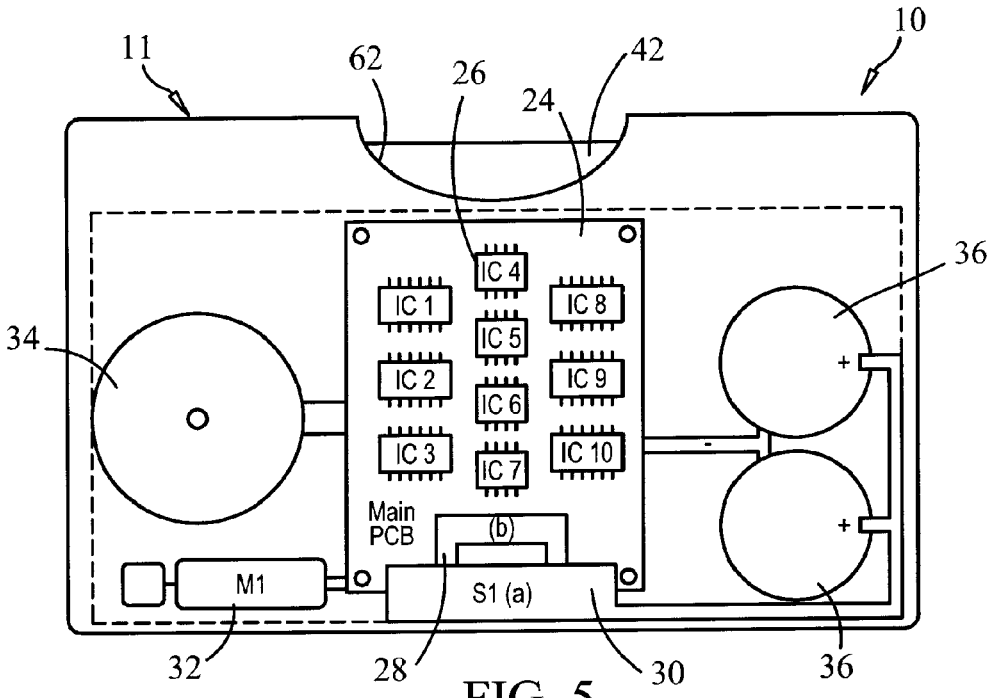
FIG. 5 is a front elevational view of the interior wall of one side of the invention showing a circuit board, IC chips, an alarm and battery circuitry.
Figure 6:
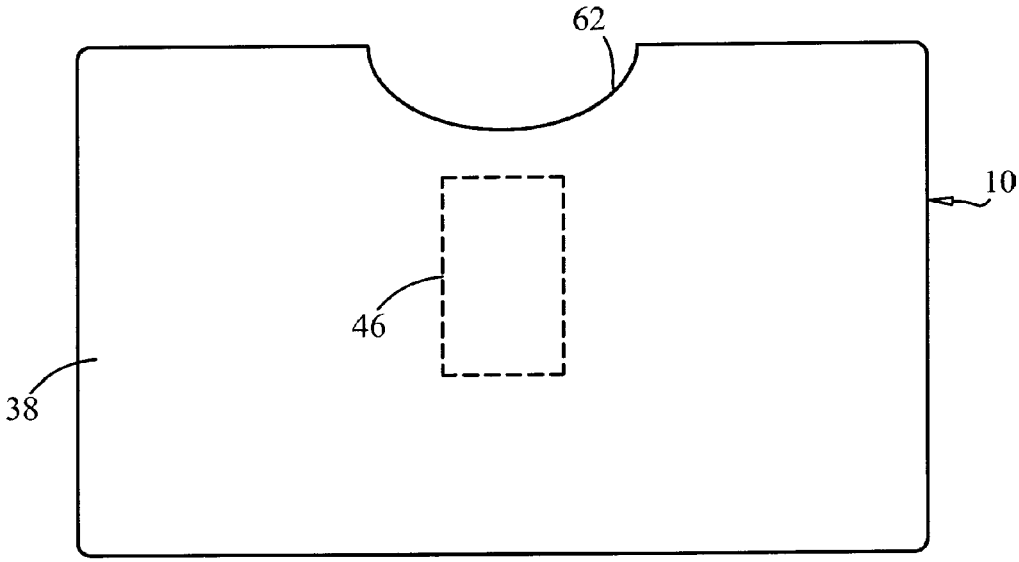
FIG. 6 shows a back elevational view of the present invention.

FIG. 5 shows the inside back wall 38 of the holder body 11. Preferably, the audible alarm 34 in FIG. 5 is a piezoelectric buzzer; however, equivalent electronic audible devices such as beepers or speakers for playing a prerecorded message are also considered. In addition to an audible alarm, a vibrator using means such as a vibrating motor 32 may be used to provide a vibration instead of or in addition to the audible alarm when the alarm is activated. In addition, it may be preferred that the switches allow the user to access data on a credit card's Smart Chip (not shown) as described below.

It may also be preferred that the display 14 is accessible through movement of a card within the card holder 10. The on/off of alarm and/or display comes from the card removal and insertion only.

In the preferred embodiment, the display 14 and the ribbon connector 22 are in electronic communication with a Smart Card interface connector 20, as shown in FIG. 4. The interface connector 20 is also in communication with the menu switches 18.

The Smart Card interface connector 20 allows the user to see charges and/or other data placed on a smart card 42.

As shown in FIG. 5, in the preferred embodiment, most of the electronic components are attached to the interior section of the back wall 38 of the holder body 11. As shown in FIG. 5, a main printed circuit board 24 is attached to the interior section of the back wall of the holder body 11. Discrete integrated circuit chips 26 are preferred to be attached to the board 24. In the preferred embodiment, the chips 26 include two ATMEGA flash memory chips with at least 4 MB EPROM and 4 MB S-RAM, operating at 16 MHz, or the equivalent. In addition, the chips 26 also preferably include eight 9830 ATMEGA chips or the equivalent.

The holder body 11 also includes an integrated card 28 in electronic communication with a positive power rail 30. The power rail 30 is situated so that a circuit is not completed when a card is located between them, and is completed when a card is removed.

In the preferred embodiment, the power is activated when a credit, debit, smart or identification card is pulled away from the rail 30. A circuit is formed by contact springs on a plate located on a main printed circuit board (described below) that contact the power rail 30. The holder body 11 includes a security feature switch 30 for the security provisions related to the card being removed from the holder body 11.

As shown, the circuit board 24 is in electronic communication with one or more power sources, such as batteries 36. Other power sources known in the art, such as one or more photovoltaic cells, are also contemplated. The board 24 is also in communication with the alarm 34 and the vibrating motor 32, if included.

The entire holder 10 may be attached to the interior of a wallet, or a wallet may be formed which includes the holder 11.

The holder 10 preferably includes software such as binary software for the application identifier when the display 14 is activated. Standard data encryption as is known in the art is preferred for the interface with the Smart Chip.

The operation of the card holder 10 is preferred to be as follows. First, a user enters a PIN number to obtain access to the card data and the system functions. If the wrong number is entered, a PIN error is displayed. Thus, unauthorized users would not be able to access the alarm functions or the data from the Smart Chip Interface.

When the display 14 is activated, the screen displays a main menu. The main menu allows the user to access to view card data such as last card payment terminal used and the amount charged. Other data may also be accessible, such as time of purchase and amount of credit left, if applicable. The display also may include a calculator function, if desired. In the preferred embodiment, the card must be inside the holder body 11 for the device to work.

The on/off mode for accessing the display 14 of the holder 11 preferably operates as follows. With the card securely in the holder 11, the user moves the card approximately one inch out of the opening 40 and then returns the card to its original position. The apparatus then provides the user with the opportunity to enter a PIN number. In the preferred embodiment, there is a predetermined time to enter the PIN number, such as 10 seconds.

If the user does not enter the PIN number within the predetermined time, then the display turns off, and the data from the Smart Chip and/or the alarm function cannot be accessed. If the user pulls the card out of the holder body 11 without replacing it shortly (such as one or two seconds) then the alarm function is preferably activated. Under such conditions, the user is alerted that the alarm has been activated. The alert may be a beep from the speaker 34 or an alternative audible means. The holder 11 then may alternatively or conjunctively sound and vibrate until the card is replaced. A delay before the alarm sounds, such as for one or two minutes may be preferred.

In the preferred embodiment, the display 14 allows the user to change the properties of the audible and/or vibration alarm 34 when access has been allowed. However, it is preferred that the user is not capable of turning off the alarm function completely. However, the user would be able to set the amount of delay before the alarm sounds, and the number and duration of beeps and/or vibrations. For example, the user may be able to set up the alarm function so that the alarm beeper will run in bursts of 4, 6 or 8 times each. Also, it is preferred that when the card is removed from the holder that the security system automatically shuts down power to the display to provide full power to the alarm. However, if a sufficiently powerful power supply is used then this feature may not be preferred.

Thus, the invention is a security system for a card holder for which an alarm is activated after a card has been removed for a predetermined period of time. The system includes a holder including a recess adapted for holding a card; an electrical contact for triggering a display located in a recess of the holder; an electrical power source in electronic communication with the contact; and a visual display located on an outer surface of the holder. The system also includes electronic circuit for providing an alarm after a predetermined delay after the removal of the card from the holder. Preferably, the system further provides for reading data from a smart chip located on the card, and means for displaying information derived from the data on the display to the user.

In an alternative embodiment, the card holder may be used to activate a new credit card, debit card, or equivalent. For example, when a user gets a new card and obtains an activation PIN number, by inputting the PIN number into the holder through the user interface and the Smart Chip interface, the user may activate his or her own card. This would be a substantial operational savings for the issuer of the card.

As described, the card holder 10 does not draw power from the power supply until contacts are in electronic cooperation. Thus, the holder 10 can be used for a substantial period of time without needing a change of power supply.

The apparatus may also be attached to a fanny pack, handbag, briefcase, or any other type of bag that might hold one or more credit cards or credit card sized identification.

Also, it is preferred that the holder 10 has an indentation 62 as shown in FIGS. 3 through 5. The indentation 62 enables the user to easily insert or remove the card 42 from the holder 10. Preferably, the indentation 62 is of a size which allows a person's fingers to tightly grip the card located inside the holder 10.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A card holder for a single credit card, debit card and or identification card, comprising:

a holder body for a card including a recess adapted for holding a card;

a visual LCD display mounted on one side of said holder body;

means for manually interacting with the display, wherein the means for interacting includes one of a touch-screen display and a plurality of buttons;

a card having a smart chip mounted within said card;

means for accessing current credit card account data stored on said smart chip within said card;

electrical contact for triggering said display located in said recess of the card holder;

a power source in electronic communication with the contact in said holder body;

means for accessing data stored on the card located on an outer surface of the card holder;

means for providing an audible alarm when said card is removed from said card holder without the entry of a security code in said card holder through said means for manually interacting with the display;

means for storing a security code including a pin number; and a circuit board mounted in said card holder body connected to said power source and said means for interacting with the display or said plurality of buttons, said circuit board including means for storing said security code, a means requiring activating said security code in order to access data on said card smart chip and for activating or deactivating said alarm that would prevent unauthorized users from accessing the alarm functions or data of the circuit board.

2. The card holder of claim 1, wherein the card holder further comprises a vibrator.

3. The card holder of claim 2, wherein the vibrator further includes a motor.

4. The card holder of claim 1, wherein the card holder includes a means for accessing said smart chip located on the card to access account data that could include payment history, account balance and available credit.

5. The card holder of claim 1, further comprising a ramp for guiding the card located in the recess of the holder.

6. The card holder of claim 1, wherein the ramp is comprised of MYLAR.

7. The card holder of claim 1, wherein the display is accessible through movement of the card within the card holder.

8. The card holder of claim 1, wherein the holder is attachable to the interior of a wallet.

9. The card holder of claim 1, wherein the outer surface of the card holder further comprises non-slip silicone.

10. A card holder sized for insertion in a wallet, comprising:

an alarm;

means for securely holding a card including an alarm;

electronic display means for accessing data from the card and for accessing the alarm located on an exterior surface of the carrier;

means for interacting with the display, wherein the means for interacting includes a touch-screen display; and means for generating a security code such as a pin number in which the user can activate the pin number preventing the audible alarm from being inadvertently set off.

11. The card carrier of claim 10, further comprising ramp means for guiding the card located on the interior surface of the card carrier.

12. The card carrier of claim 10, further comprising indented means for easily gripping and removing the card while inside the carrier located at a near end of the carrier.

13. The card carrier of claim 12, wherein the indented means are complementary to the size of a user's finger.

14. The card carrier of claim 10, wherein the electronic display means further comprises a means for securing the card within the carrier, whereby removal of the card from the means for securing the card activates the alarm after a pre-determined delay.

15. The card carrier of claim 10, wherein the carrier further comprises means for reading data from a smart chip located on the card, and means for displaying information derived from the data on the display.

16. The card carrier of claim 10, wherein the display includes means for inputting user data.

* * * * *